United States Patent [19]

Moore et al.

[11] 4,341,284

[45] Jul. 27, 1982

[54] SILENCER MEANS FOR INTERNAL COMBUSTION ENGINES

[75] Inventors: James W. Moore; Rudolph A. Peterson, Jr., both of Horicon, Wis.

[73] Assignee: Deere & Company, Moline, Ill.

[21] Appl. No.: 105,772

[22] Filed: Dec. 20, 1979

[51] Int. Cl.[3] ..... F01N 1/08

[52] U.S. Cl. ..... 181/272

[58] Field of Search ..... 181/264, 269–275

[56] References Cited

U.S. PATENT DOCUMENTS

| | | | |
|---|---|---|---|
| 3,795,287 | 3/1974 | Rose | 181/283 |
| 3,810,518 | 5/1974 | Smale | 181/272 X |
| 4,055,231 | 10/1975 | Martinez | 181/241 |
| 4,122,914 | 10/1978 | Suyama | 181/258 |
| 4,143,739 | 3/1979 | Nordlie | 181/265 |
| 4,192,404 | 3/1980 | Nakagawa et al. | 181/281 |

FOREIGN PATENT DOCUMENTS

| | | | |
|---|---|---|---|
| 652999 | 8/1935 | Fed. Rep. of Germany | 181/272 |
| 1116944 | 5/1956 | France | 181/272 |

*Primary Examiner*—L. T. Hix
*Assistant Examiner*—Thomas H. Tarcza

[57] ABSTRACT

A silencer means particularly suited to two-cycle internal combustion engines includes an exhaust inlet pipe to receive exhaust from the exhaust ports of an engine, communicating with a diverging conical section which is followed by an exhaust chamber. An elliptically-shaped flat plate is located in the straight tubular section comprising the exhaust chamber. The plate is angled to produce a converging area at the end of the expansion chamber. An exhaust pipe or stinger is in communication with the interior of the expansion chamber in close proximity to the surface of the flat plate to receive engine exhaust gases and conduct the gases to the surrounding environment. Alternatively, the stinger can be so constructed that both ends of the stinger are closed, having a plurality of perforations in proximity to each end of the stinger to receive and exhaust gases to the surrounding environment from the exhaust chamber.

2 Claims, 6 Drawing Figures

SILENCER MEANS FOR INTERNAL COMBUSTION ENGINES

BACKGROUND OF THE INVENTION

The present invention relates to exhaust system for use in conjunction with internal combustion engines, and more particularly, to silencers or tuning chambers used in conjunction with a two-cycle internal combustion engine.

Conventional tuning chambers used in conjunction with twocycle engines as employed for example on snowmobiles include an exhaust pipe communicating with the engine exhaust port followed by a diverging conical section, an exhaust chamber, and a converging conical section leading to a tail pipe or stinger. The diverging conical section, exhaust chamber, and converging conical section are collectively referred to as a tuning chamber. Each of these components perform an important function in timing the exhaust from a two-cycle engine to attain the maximum power. This is because the pressure pulse created in the tuning chamber by the flow of exhaust gases therethrough can be advantageously used to increase engine efficiency.

The divergent and convergent conical sections are formed by a rather elaborate stamping die, or hand fabrication process to get the proper shape. The manufacturing process is further complicated by the fact that the length and rate of area change of the conical sections are critical to the performance of the engine and are different for each type of two-cycle engine.

The present invention presents an improved tuning chamber which can be fabricated without the need for expensive stamping dies and fabricating procedures.

SUMMARY OF THE INVENTION

The improved tuning chamber includes an exhaust pipe leading to a diverging conical section followed by an exhaust chamber. A generally elliptically-shaped flat plate is located in the exhaust chamber. The plate is angled to produce a converging cross-sectional area at the end of the exhaust chamber. A stinger has one end located in close proximity to the surface of the elliptical flat plate to receive engine exhaust gases in the exhaust chamber and conduct the gas to the surrounding environment. Increased engine performance can be derived by arching the plate within the exhaust chamber to approximate a megaphonic area reduction within the exhaust chamber. Silencer performance can also be increased by closing both ends of the stinger and providing a plurality of perforations in the proximity of each end of the stinger, the stinger to receive exhaust gas from the exhaust chamber through the perforation at one end of the stinger and release the gases to the surrounding environment through the perforation at the other end.

It is an object of the present invention to describe a tuning chamber particularly suited for two-cycle engines which can be manufactured with a reduced need for stamping dies and fabricating procedures.

It is also an objective of the present invention to present an exhaust system means which can be tuned to the exhaust characteristic of different engine with relative ease thereby realizing considerable savings in material and weight.

DETAILED DESCRIPTION OF THE PREFERRED EMBODIMENT

Figure 1:
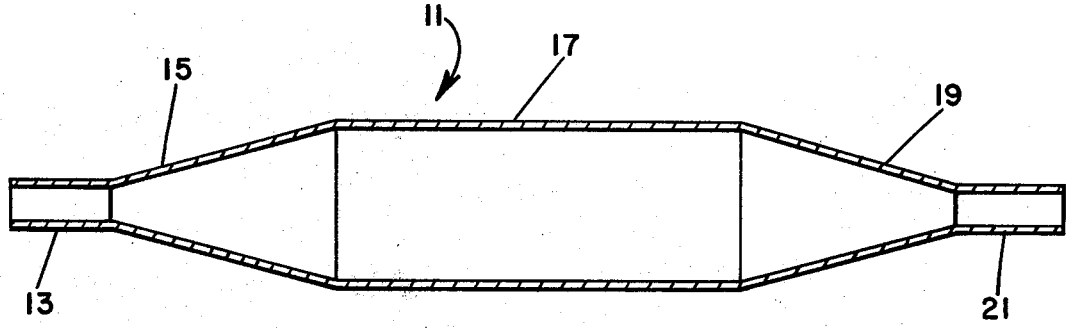
FIG. 1 PRIOR ART
FIG. 1 is a sectional view of a conventional tuning chamber.

Referring to FIG. 1, a tuning chamber generally indicated as 11, commonly used in conjunction with two-cycle engines employed in vehicles such as snowmobiles is comprised of exhaust pipe 13 in communication with the exhaust ports of an engine (not shown) followed by a diverging conical section 15, an exhaust chamber 17 having a generally cylindrical configuration; a converging conical section 19; and, an exhaust pipe or stinger 21. It is generally known in the art, that the back pressure created by the flow of exhaust gas through the tuning chamber 11 can be beneficially used to derive optimum fuel charging of a two-cycle engine's combustion chambers. This is so, because the intake of fuel and the release of exhaust gases from the engine cylinder accrue almost simultaneously; therefore, the back pressure developed within the tuning chamber 11 can be timed to reinject any fuel which has leaked through the engine exhaust ports back into the engine cylinders or combustion chamber. Therefore, by adjusting the specification or timing of a conventional silencer 11 to the particular variety of two-cycle engine to be used, the engine efficiency can be improved.

Figure 2:
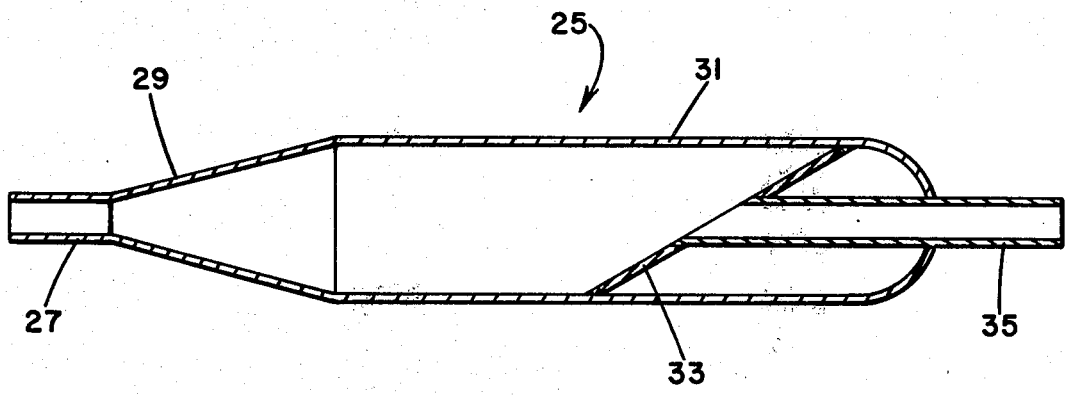
FIG. 2 is a side sectional view of a tuning chamber utilizing a single elliptically-shaped flat plate.

Referring to FIG. 2, an improved tuning chamber 25 particularly suited for a two-cycle engine includes an exhaust pipe 27, a diverging conical section 29, an exhaust chamber 31 of generally cylindrical configuration wherein an elliptically-shaped plate 33 is fixably mounted by any conventional means in an angled orientation. A tail pipe or stinger 35 is fixably mounted by any conventional means to the plate 33 such that one end of the stinger 35 extends through the surface of plate 33 to receive exhaust gas from the exhaust chamber 31. The angling of plate 33 which has a planular contour produces a converging area at the end of exhaust chamber 31.

Figure 3:
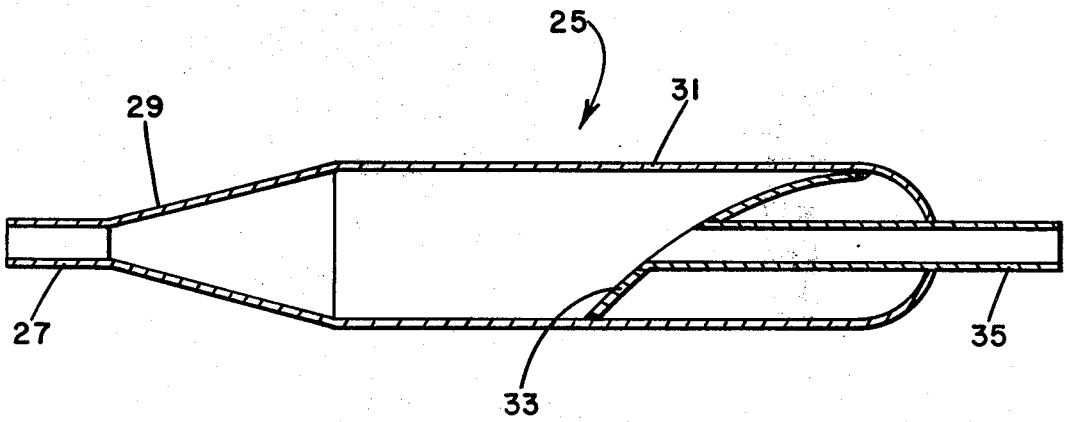
FIG. 3 is a side sectional view of a tuning chamber utilizing a single elliptically-shaped plate arched within the exhaust chamber of the silencer.

Referring to FIG. 3, further benefit from the present invention can be realized by placing the generally elliptically-shaped plate 33 in the exhaust chamber 31 such that the plate 33 is bent or arched along about its major and/or minor axis. When the plate 33 is bent or arched a megaphonic area reduction is approximated within the exhaust chamber which results in improved engine performance. The improved engine performance resulting from arching plate 33 to create a converging section can be achieved at no additional assembly cost and with little additional manufacturing cost.

Figure 4:
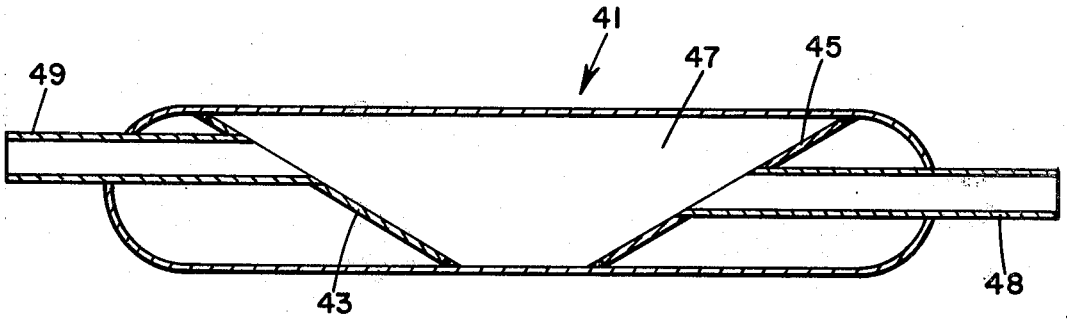
FIG. 4 is a side sectional view of a tuning chamber utilizing a plurality of elliptically-shaped plates.

Referring to FIG. 4, an improved silencer, generally indicated as 41, utilizes two elliptically-shaped plates 43 and 45 fixably mounted within the exhaust chamber 47 by any conventional means. One end of an exhaust pipe 49 is fixably mounted by any conventional means to the plate 43 to be generally flush with the surface of plate 43 and vertically removed above the horizontal center line or minor axis of the elliptical plate 43 to deliver engine exhaust gases to the exhaust chamber 47. The plate 43 is angled to produce a divergent area within the exhaust chamber. The plate 45 is angled within the exhaust chamber 47 to produce a convergent area. The stinger 48 being fixably mounted by any conventional means to the plate 45 to receive exhaust gas from within the exhaust chamber 47 and deliver the gas to the surrounding environment. It is understood that by arching plates 43 and 45 along their respective major axis within the exhaust chamber, the performance of silencer 41 can be further increased.

Figure 5:
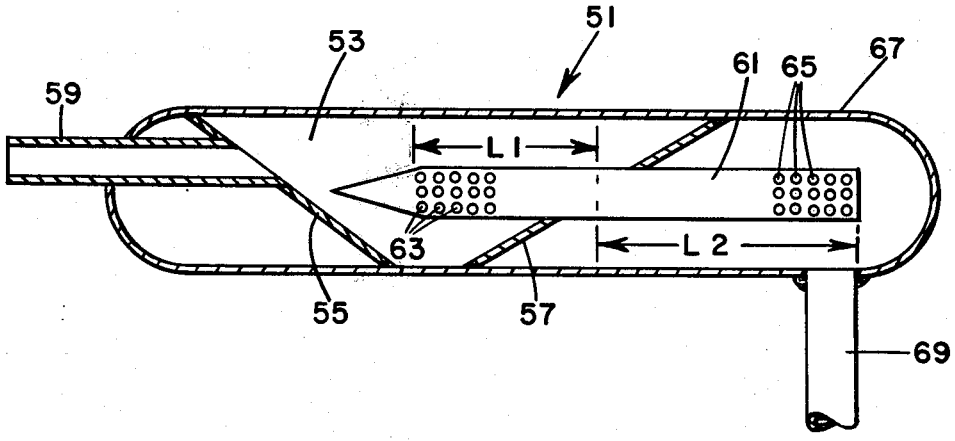
FIG. 5 is a side sectional view of a tuning chamber with an improved stinger.

The conventional tuning chamber of the type shown in FIG. 1 uses a flow-through stinger, indicated in FIG. 1 as 21. By providing an improved stinger additional silencing of engine noise is obtained. Referring to FIG. 5, a tuning chamber, a generally indicated as 51, includes an exhaust chamber 53 having a plurality of elliptically-shaped plates 55 and 57 fixably mounted therein by any conventional means. An exhaust pipe 59 is fixably mounted by any conventional means to plate 55 generally vertically elevated with respect to the horizontal centerline of plate 55, plate 55 being angled to produce a divergent area. Plate 57 is angled within exhaust chamber 53 to produce a convergent area.

An elongated stinger 61 is fixably mounted by any conventional means to plate 57 such that a hot insubstantial portion of stinger 61 projects into the exhaust chamber 53. Optimally, each end of stinger 61 is closed, the end of stinger 61 within the exhaust chamber 53 preferably being pressed closed and the other end of stinger 61 preferably being capped. In the proximity of each end of stinger 61 is a plurality of perforations 63 and 65, such that gas within the exhaust chamber 53 is admitted in the stinger 61 through perforation 63 and released through perforation 65.

Figure 6:
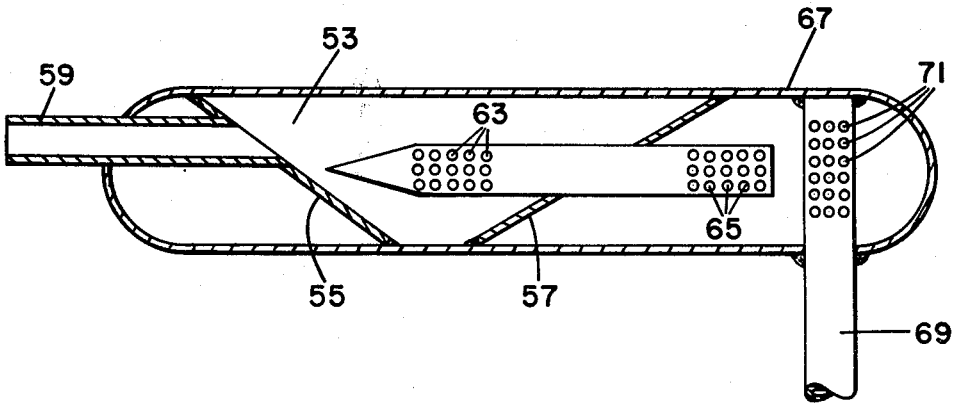
FIG. 6 is a side sectional view of an exhaust system with an improved stinger and a perforated tail pipe.

Further silencing can be obtained by placing an enclosure 67 around that portion of the stinger previously exposed to the environment, the enclosure 67 having a tail pipe 69 therein. Referring to FIG. 6, one end of the tail pipe 69 can be extended into the enclosure 67, closed, and provided with a plurality of perforations 71 to allow the flow of gas into pipe 69.

The elliptically-shaped plates can be manufactured from a simple blanking die or cut from a sheet of metal thus eliminating the need for expensive stamping and forming dies and can be easily changed to fit in different size exhaust chambers. The lift and angle of the plates as mounted can be altered to tune an exhaust system for different types of engines. When a perforated stinger is employed, further silencer effectiveness can be obtained by adjusting the critical lengths, indicated in FIG. 5 as $L_1$ and $L_2$. The time and labor of assembly for a flat plate converging section is also less than for the more complex conventional convergent cone. It is also apparent that a considerable savings in material and weight can be realized with the present invention.

We claim:

1. In combination with a two-cycle engine, a silencer including a housing defining a generally cylindrical shaped chamber closed at the ends, a first plate having a generally elliptical shape fixedly mounted rearwardly in said chamber in an angled orientation to form a converging longitudinal crosssection area in said chamber, said first plate's periphery being in continuous communication with portion of said housing, a second plate having a generally elliptical shape fixably mounted forward in said chamber in an opposing angled orientation to said first plate to form a diverging longitudinal cross-section area in said chamber, said second plate's periphery being in continuous communication with a portion of said housing, said first and second plates being in longitudinally spaced relationship, an exhaust pipe leading from said engine's exhaust ports to said chamber, a portion of said exhaust pipe being fixably mounted in said second plate, wherein the improvement comprises, a stinger fixably mounted in said first plate and closed at each end having a first portion extending forward of said first plate, and a second portion extending rearward of said first plate and enclosed by said housing, said stinger having a plurality of perforations placed around each end, a tail pipe fixably mounted in said housing rearward of said first plate.

2. A silencer as claimed in claim 1 wherein said tail pipe has a portion contained in said housing rearward of said first plate, said portion being closed at the end and having plurality of perforations.

* * * * *